US005249096A

United States Patent [19]

Williams

[11] Patent Number: 5,249,096

[45] Date of Patent: Sep. 28, 1993

[54] HEATING ELEMENT OPERATING UNIT, CONTROL DEVICE THEREFOR AND METHODS OF MAKING THE SAME

[75] Inventor: Kurt T. Williams, Holland, Mich.

[73] Assignee: Robertshaw Controls Company, Richmond, Va.

[21] Appl. No.: 826,967

[22] Filed: Jan. 28, 1992

[51] Int. Cl.[5] ..... F23Q 7/00; F23Q 13/02

[52] U.S. Cl. ..... 361/264; 323/322

[58] Field of Search ..... 361/264, 20, 265, 266; 323/241, 300, 322; 431/27, 70, 71, 31, 29; 307/639, 643

[56] References Cited

U.S. PATENT DOCUMENTS 4,239,986 12/1980 Dobkin ..... 307/252 B
4,711,628 12/1987 Geary ..... 431/31
4,809,128 2/1989 Geary ..... 361/264
4,856,983 8/1989 Geary ..... 431/27
4,976,605 12/1990 Geary ..... 431/27

*Primary Examiner*—Jeffrey A. Gaffin
*Assistant Examiner*—Aditya Krishnan
*Attorney, Agent, or Firm*—Candor, Candor & Tassone

[57] ABSTRACT

A heating element operating unit, control device therefor and methods of making the same are provided, the control device being adapted to operate a heating element that comprises a hot surface igniter with a certain repeating pattern of a single complete half-wave pulse in each repeating pattern of at least two complete full-wave pulses of a source of high voltage alternating current for a predetermined time period, the control device utilizing a staircase generator of two transistors for operating the heating element.

4 Claims, 2 Drawing Sheets

HEATING ELEMENT OPERATING UNIT, CONTROL DEVICE THEREFOR AND METHODS OF MAKING THE SAME

BACKGROUND OF THE INVENTION

1. Field of the Invention

This invention relates to a new control means for operating a heating element means that comprises a hot surface igniter for a gas furnace and to a new method of making the same.

2. Prior Art Statement

It is known to provide a combination of a heating element means that comprises a gas igniter for a gas furnace and is normally adapted to be operated by the continuous full-wave pulses of a certain high voltage alternating current source for a predetermined time period so as to provide a certain power output to the heating element means that provides a desired gas ignition function thereof, and control means that is operatively interconnected to the heating element means and has operating means for operating the heating element means with a certain repeating pattern of at least two complete full-wave pulses of a second source of high voltage alternating current for the predetermined time period when the second source has a higher voltage than the certain source so that the heating element means will not be adversely affected by the second source of higher voltage and will still provide the desired gas ignition function thereof in the predetermined time period. For example, see the Geary U.S. Pat. No. 4,809,128.

Also, see the Geary U.S. Pat. Nos. 4,711,628; 4,856,983 and 4,976,605 for similar hot surface ignition systems.

SUMMARY OF THE INVENTION

It is a feature of this invention to provide new means for operating the heating element means with a certain repeating pattern of a single complete half-wave pulse in each repeating pattern of at least two complete full-wave pulses of a source of high voltage alternating current for a predetermined time period.

For example, the prior known heating element system of the aforementioned Geary U.S. Pat. No. 4,809,128, utilizes a counter or divider for such purpose.

However, it was found according to the teachings of this invention that the control means can comprise a staircase generator of two transistors uniquely interconnected to the hot surface igniter so as to provide for a certain repeating pattern of a single complete half-wave pulse in each repeating pattern of at least two complete full-wave pulses of the source of high voltage alternating current.

Such an electrical arrangement is believed to be substantially impervious to noises which might cause a burnout of the hot surface igniter.

Accordingly, it is an object of this invention to provide a new combination of a heating element and a control means, the combination of this invention having one or more of the novel features of this invention as set forth above or hereinafter shown or described.

Another object of this invention is to provide a new method of making such a combination, the method of this invention having one or more of the novel features of this invention as set forth above or hereinafter shown or described.

Another object of this invention is to provide a new control device for operating a heating element means, the control device of this invention having one or more of the novel features of this invention as set forth above or hereinafter shown or described.

Another object of this invention is to provide a new method of making such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
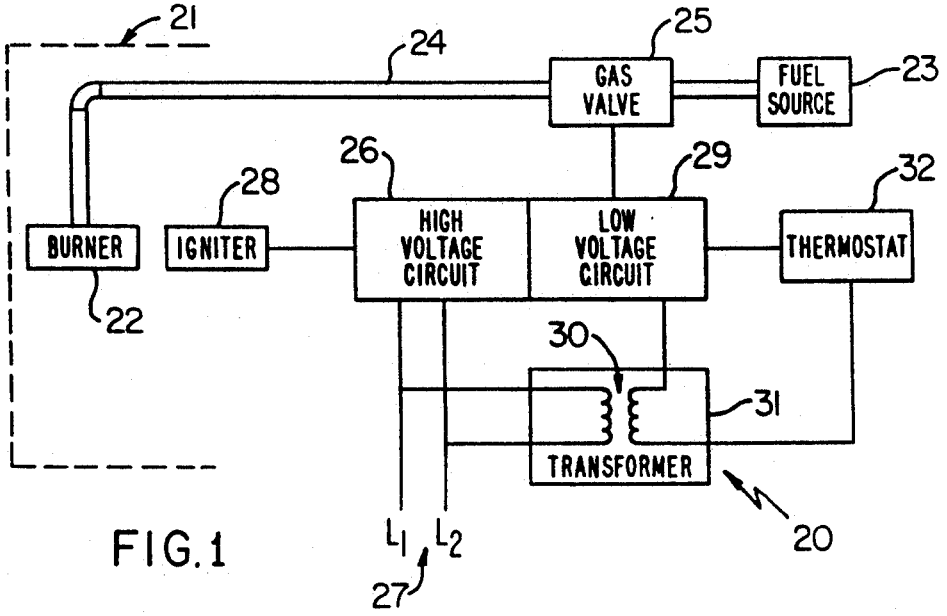
FIG. 1 is a schematic view, mainly in block diaphragm form, illustrating the new combination of this invention that comprises a hot surface igniter and a control means for operating the igniter.

While the various features of this invention are hereinafter illustrated and described as being particularly adapted to provide a control means for a hot surface ignition system for a gas furnace, it is to be understood that the various features of this invention can be utilized singly or in various combinations thereof to provide a control means for other systems as desired.

Therefore, this invention is not to be limited to only the embodiment illustrated in the drawings, because the drawings are merely utilized to illustrate one of the wide variety of uses of this invention.

Referring now to FIG. 1, the new hot surface ignition system of this invention is generally indicated by the reference numeral 20 and is utilized for a gas furnace that is generally indicated by the reference numeral 21 and which has a main burner 22 therein that is adapted to be supplied fuel thereto from a fuel source 23 through a conduit means 24 when an electrically operated gas valve 25 is opened in a manner hereinafter set forth, the gas valve 25 being part of the hot surface ignition system 20 that further comprises a high voltage circuit or control means 26 being interconnected to a source 27 of high voltage alternating current. The high voltage circuit or control means 26 has a hot surface igniter means 28 therein which is disposed in the path of gas issuing from the burner means 22. The hot surface ignition system 20 also comprises a low voltage circuit or control means 29 for being connected to a source 30 of low voltage alternating current, such as provided by a step-down transformer 31 in a manner well known in the art. The low voltage circuit or control means 29 has the gas valve 25 therein and has a thermostatic switch means 32 therein for controlling the energization of the low voltage circuit 29 with the source 30 of low voltage alternating current.

Figure 2:
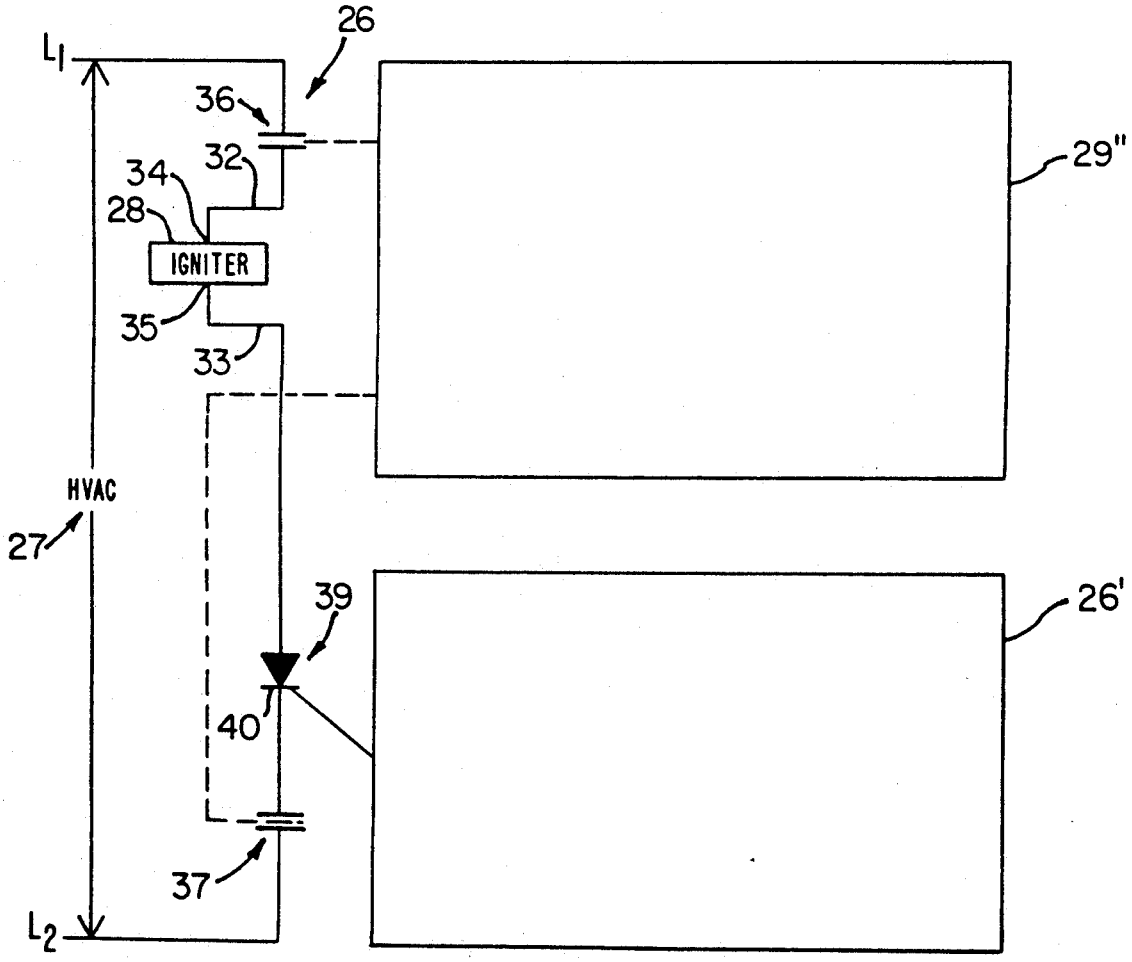
FIG. 2 illustrates the entire wiring circuit of this invention for operating the ignition system of FIG. 1.

The source 27 of high voltage alternating current comprises the power source leads L1 and L2 as illustrated in FIGS. 1 and 2 and the high voltage circuit 26 of FIG. 2 comprises the igniter 28 and lead means 32 and 33 that are adapted to respectively interconnect the opposed sides 34 and 35 of the igniter 28 to the leads L1 and L2, the lead means 32 and 33 respectively having normally open contacts 36 and 37 of a relay (not shown) therein that is operated by a portion 29" (FIG. 2) of the low voltage circuit or control means 29 in the manner fully set forth in the aforementioned Geary U.S. Pat. No. 4,711,628, whereby this U.S. patent is being incorporated into this disclosure by this reference thereto.

As illustrated in FIG. 2, a half-wave rectifier 39 or SCR is disposed in the lead means 33 so as to be in series with the igniter 28 when the relay contacts 36 and 37 are closed, the rectifier 39 having a gate 40 that is controlled by the output of a portion 26' of the high voltage circuit 26 of FIG. 1.

In particular, the portion 26' of the control means 26 controls the gate 40 of the rectifier 39 so as to operate the igniter 28 when the relay contacts 36 and 37 are closed with a certain repeating pattern of a single complete half-wave pulse in each repeating pattern of at least two complete full-wave pulses of the source 27 of high voltage alternating current for a predetermined time period so as to provide a certain power output to the igniter 28 for igniting fuel that issues from the main burner 22 for the same reasons that are fully set forth in the aforementioned patent to Geary U.S. Pat. No. 4,809,128, whereby this U.S. patent is also being incorporated into this disclosure by this reference thereto.

Thus, since the details of the structure and the operation of the control means 26 and 29, except for the portion 26' that comprises the features of this invention, are fully set forth in the aforementioned U. S. patents to Geary U.S. Pat. Nos. 4,711,628 and 4,809,128, only the details of the new portion 26 of the system 20 will now be set forth.

Figure 3:
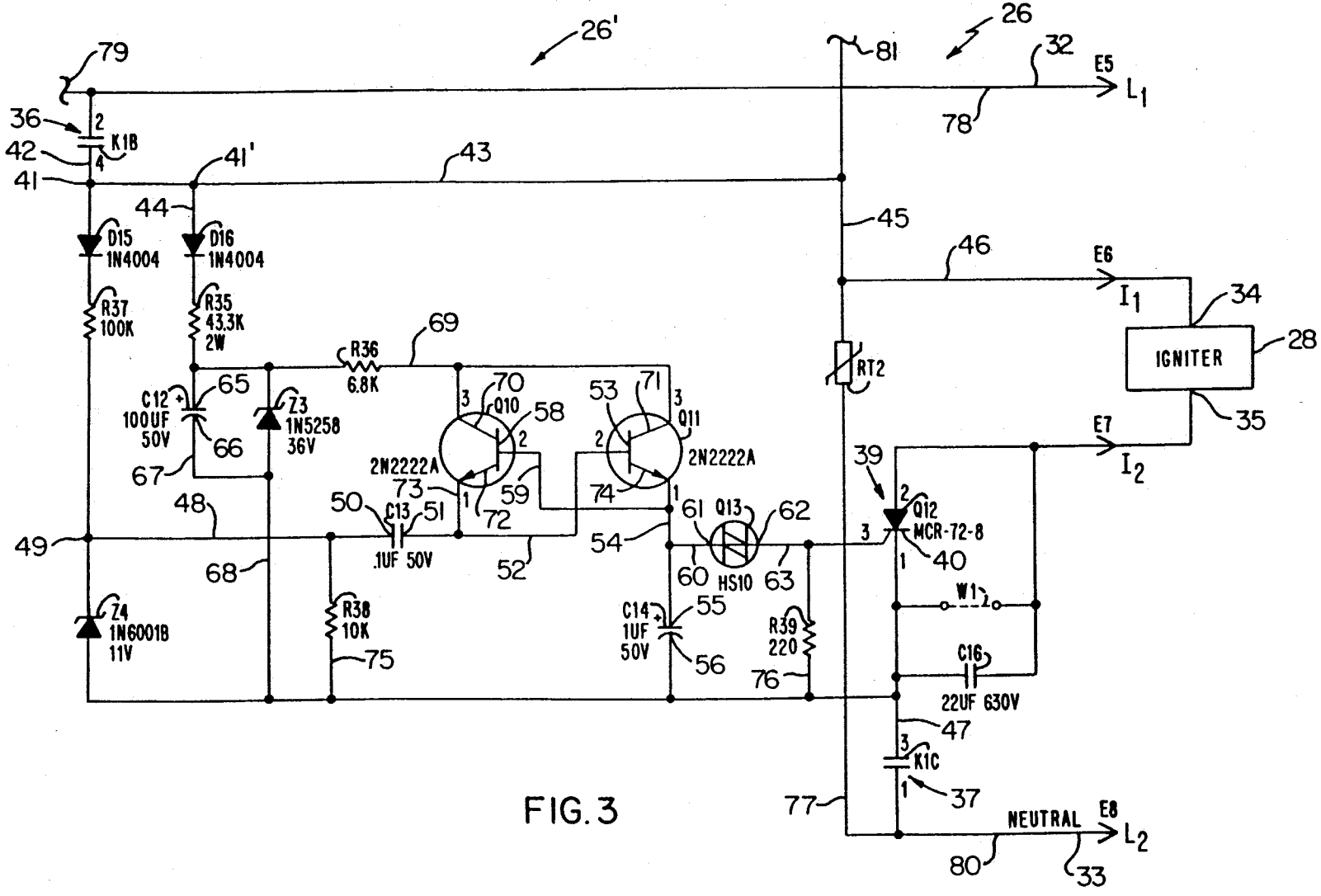
FIG. 3 is a fragmentary schematic view illustrating part of the e circuit of FIG. 2.

Referring now to FIG. 3, it can be seen that the various components of the electrical circuit means 26' of this invention are respectively given reference characters that are common in the art to represent the components, such as C for a capacitor, R for a resistor, D for a diode, Q for a transistor, SCR, breakover device, etc., and a capital Z for a zener diode with each capital letter being followed by a numerical number to distinguish that particular reference letter from the other reference letters of similar components. Therefore, only the components believed necessary to understand the various features of this invention will be hereinafter specifically mentioned and it can be seen that such components are electrically connected by electrical lines as illustrated in FIG. 3.

As illustrated in FIG. 3, the control means 26' comprises diodes D15 and D16, zener diodes Z3 and Z4, transistors Q10 and Q11, SCR Q12, capacitors C12, C13, C14 and C16, resistors R35, R36, R37, R38 and R39 and a breakover device Q13.

The relay contacts 37, also designated K1B, when closed are adapted to interconnect the power source L1 to a point 41 on a lead 42 that leads to the diode D15 as well as to a lead 43 that interconnects with a lead 44 connected to the diode D16 and to leads 45 and 46 that lead to the one side 34 of the igniter 28.

The lead 42 has the diode D15, the resistor R37 and the zener diode Z4 therein in series and interconnects with a lead 47 that is adapted to interconnect to the side 35 of the igniter 28 when the relay contacts 36 are closed.

The relay contacts 37, being designated K1C in FIG. 3, are adapted to interconnect the power source lead L2 to the lead 47 when closed simultaneously with the closing of the relay contacts 36 when the circuit means 29" energizes a solonoid relay coil (not shown) for activating the igniter 28 in a manner hereinafter set forth.

The circuit means 26' has a lead 48 that joins with the lead 42 at a point 49 intermediate the resistor R37 and the zener diode Z4 and is connected to one side 50 of the capacitor C13. The other side 51 of the capacitor C13 is interconnected by a lead 52 to a base 53 of the transistor Q11 that has its emitter 74 interconnected by a lead 54 to the positive side 55 of the capacitor C14. The other side 56 of the capacitor C14 is interconnected by a lead 57 to the lead 42 at a point intermediate the zener diode Z4 and the lead 47 as illustrated.

The base 58 of the transistor Q10 is interconnected by a lead 59 to the lead 54 and the lead 54 is interconnected by a lead 60 to one side 61 of the breakover device Q13 while the other side 62 of the breakover device Q13 is interconnected by a lead 63 to the gate 40 of the SCR Q12, the SCR Q12 being disposed in the lead 47 intermediate the relay contact means 37 and the side 35 of the igniter 28 as illustrated.

While the breakover device Q13 can be any suitable breakover device, in one working embodiment of this invention, the breakover device Q13 comprises a bilateral silicon trigger switch sold as HS10 by Teccor Electronics, Inc. of Irving, Tex.

The lead 44 of the circuit means 26' has the diode D16 and the resistor R35 therein in series and interconnects to the positive side 65 of the capacitor C12 which has its other side 66 interconnected by a lead 67 to a lead 68 that interconnects the lead 42 intermediate the zener diode Z4 and the lead 47 to a lead 69, the lead 68 having the zener diode Z3 therein.

The lead 69 of the circuit means 26' has the resistor R36 therein and interconnects the lead 44 intermediate the resistor R35 and the capacitor C12 to the collector 70 of the transistor Q10 as well as to the collector 71 of the transistor Q11.

The emitter 72 of the transistor Q10 is interconnected by a lead 73 to the lead 52 intermediate the capacitor C13 and the base 53 of the transistor Q11 while the emitter 74 of the transistor Q11 is interconnected to the lead 54 as illustrated.

In this manner, the transistors Q10 and Q11 are arranged in a conventional manner to be a staircase generator as will be apparent hereinafter.

The resistor R38 of the circuit means 26' is interconnected by a lead 75 between the leads 42 and 48. Similarly, the resistor R39 is interconnected between the leads 42 and 63 by a lead 76.

A varistor or MOV RT2 is interconnected by a lead 77 between the power source leads 46 and 47 and is merely utilized for transient voltage protection in a manner well known in the art.

The power source L1 is interconnected by a lead 78 to the relay contact means 36 and to the circuit means 26 at the point 79. Similarly, the lead L2 is interconnected by a lead 80 to the lead 47 which is also interconnected to the lead 77. The lead 45 is also interconnected to the circuit means 26 at the point 81.

Thus, it can be seen that the leads 42, 43, 45 and 46 of FIG. 3 comprise the lead 32 of FIG. 2 and the lead 47 of FIG. 3 comprises the lead 33 of FIG. 2.

The various values for the various components of the circuit means 26' are set forth in FIG. 3 and all resistor values are in ohms, 0.25 watt±5% and all capacitor values are 63 V minimum±20% unless otherwise shown on the drawings.

The circuit means 26′ is so constructed and arranged that when the relay contact means 36 and 37 are closed, one complete half-wave pulse of the high voltage source 27 is permitted to pass through the igniter 28 for each two full-wave pulses of the high voltage source 27 and this permits the igniter 28 to be a 120 volt rated igniter that is normally continuously operated by the continuous pulses of an alternating current source that has only a voltage of 120 volts. However, such igniter 28 can be utilized in the system 20 of this invention wherein the high voltage source 27 is a 240 volt source and, therefore, will not cause the igniter 28 to burn out all for the reasons fully set forth and claimed in the aforementioned Geary U.S. Pat. No. 4,809,128.

The specific operation of the circuit means 26′ of this invention will now be described.

When the circuit means 29 is activated to turn on the burner 22 by the thermostat 32 closing, the circuit means 29″ causes the relay contact means 36 and 37 to close and the circuit means 26′ causes the igniter 28 to be energized and thereby ignite fuel that issues from the burner means 22.

In particular, when the relay contact means 36 and 37 close and are held closed by the circuit means 29″ as long as the thermostat 32 is demanding heat from the burner means 22, power from L1 will come in on line 42 of the circuit means 26′ and is applied at points 41 and 41′. The voltage signal at point 41 passes through the diode D15 and the resistor R37 and is clipped by the zener diode Z4 at the point 49 so that a square wave of from zero to approximately eleven volts will be transferred by the line 48 through the capacitor C13 to the capacitor C14 with this transfer taking place in two steps.

In the first step, the capacitor C13 goes from zero volts to eleven volts on the first cycle and this causes the transistor Q11 to turn on as the capacitor C13 is interconnected by the line 52 to the base 53 thereof. The turned on transistor Q11 will charge the capacitor C14 while the voltage is going from zero volts to eleven volts across the capacitor C13 but because of line losses, etc. C14 charges to only about seven volts. Once the capacitor C13 has reached eleven volts and now starts to go from eleven volts back toward zero volts, the transistor Q11 will turn off. As the capacitor C13 goes from eleven volts toward zero volts, this causes the transistor Q10 to turn on and thus tends to charge the capacitor C13 to the voltage value across capacitor C14 which is approximately seven volts. Once the capacitor C13 has reached the seven volts, the transistor Q10 turns off. However, the capacitor C14 remains charged with its seven volts since there is no discharge path until the next cycle begins. In the second step, once the next or second cycle begins, the capacitor C13 will charge up again to the eleven volts plus the previous seven volts placed thereon by the transistor Q10. This again causes the transistor Q11 to turn on and charge capacitor C14 to the new value of capacitor C13 and once the value on the line 54 rises above the breakover value of the breakover device Q13, such as approximately ten volts, the breakover device Q13 will break over and allow the voltage on the capacitor C14 to be discharged through the resistor R39 and the gate 40 of the SCR Q12. The value of the resistor R39 is chosen so that the discharge of the capacitor C14 will take approximately 220 micro seconds which is more than enough time needed to cause the SCR Q12 to fire. This is necessary to ensure that the firing of the SCR Q12 does not carry over into the next half cycle causing a latching condition.

It can be seen that without the breakover device Q13, the circuit operation of two transistors Q10 and Q11 of the circuit means 26″ as a staircase generator would allow the capacitor C14 to be charged each cycle until it reached the value of the zener diode Z3 which is approximately 36 volts. However, since the breakover device Q13 is utilized, the capacitor C14 can never reach 36 volts. The values of the zener diode Z3 and the capacitor C12 are so chosen that there is more than enough voltage and current to charge the capacitor C14 when it is calling for the charge.

Thus, it can be seen that the first cycle of current that comes in at point 41 on the line 42 upon the closing of the relay contacts 36 and 37 causes the capacitor C14 to charge. The next cycle that comes in at the point 41 causes the breakover device Q13 to break over and trigger the SCR Q12 which permits a full or complete half-wave pulse of the alternating current source 27 to pass through the igniter 28 to energize the same. Thus, the circuit means 26′ continues to pass a full or complete half-wave pulse of the high voltage source 27 through the igniter 28 for each two full-wave pulses thereof as long as the relay contacts 36 and 37 remain closed.

In this manner, the igniter 28 is operated as if it were seeing a source of 120 volts being continuously applied across the same even though the high voltage source 27 is a 240 volt source which, if applied continuously across the igniter 28, would adversely burn out the same in a relatively short time.

Also, it is to be understood that in a manner similar to the system set forth in the aforementioned Geary U.S. Pat. No. 4,809,128, the 120 volt rated igniter 28 could be utilized with higher voltages at the source 27 than the 240 volts previously described, such as on a 277 volt source as the values of the capacitors C13 and C14 could be changed so as to apply the full or complete half-wave pulse to the igniter 28 for every 3 full-wave pulses or every 4 full-wave pulses of the source 27 as desired.

Thus, when the circuit means 29 of the system 20 determines that the fuel now issuing from the burner 22 has been ignited by the energized igniter 28, the circuit means 29 causes the relay contacts 36 and 37 to open and thereby discontinue the energizing of the igniter 28 until the system 20 determines that the igniter 28 should again be operated, such as by the thermostat subsequently opening and then closing again.

Thus, it can be seen that this invention not only sets forth a new hot surface igniter system for a gas furnace and a new control device for such a system, but also this invention sets forth new methods of making such a system and such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In the combination of a heating element means that comprises a gas igniter for a gas furnace and is normally adapted to be operated by the continuous full-wave pulses of a certain high voltage alternating current source for a predetermined time period so as to provide a certain power output to said heating element means that provides a desired gas ignition function thereof, and control means that is operatively interconnected to said heating element means and has operating means for operating said heating element means with a certain repeating pattern of a single complete half-wave pulse in each repeating pattern of at least two complete full-wave pulses of a second source of high voltage alternating current for said predetermined time period when said second source has a higher voltage than said certain source so that said heating element means will provide said desired gas ignition function thereof in said predetermined time period, the improvement wherein said operating means of said control means comprises a staircase generator of two transistors, said operating means for operating said heating element means with a certain repeating pattern comprising a half-wave rectifier for being disposed in series with said heating element means across said second source, said operating means for operating said heating element means with a certain repeating pattern comprising means operatively interconnected to said rectifier to cause said rectifier to fire only at certain half-wave pulses of said second-mentioned source so as to provide said repeating pattern, said rectifier comprising an SCR that has a gate, said means operatively interconnected to said rectifier comprising a capacitor and a breakover device disposed intermediate said gate of said SCR and said staircase generator of said two transistors.

2. The combination as set forth in claim 1 wherein each of said two transistors has a base and an emitter, said capacitor having one side thereof electrically interconnected to said base of one of said two transistors and to said emitter of the other of said two transistors, said one of said two transistors having said emitter thereof interconnected to said base of said other of said two transistors, said breakover device having one side thereof interconnected to said gate of said rectifier and the other side thereof interconnected to said one side of said capacitor.

3. In a control device for operating a heating element means that comprises a gas igniter for a gas furnace and is normally adapted to be operated by the continuous full-wave pulses of a certain high voltage alternating current source for a predetermined time period so as to provide a certain power output to said heating element means that provides a desired gas ignition function thereof, said control device being adapted to be operatively interconnected to said heating element means and comprising operating means for operating said heating element means with a certain repeating pattern of a single complete half-wave pulse in each repeating pattern of at least two complete full-wave pulses of a second source of high voltage alternating current for said predetermined time period when said second source has a higher voltage than said certain source so that said heating element means will provide said desired gas ignition function thereof in said predetermined time period, the improvement herein said operating means of said control device comprises a staircase generator of two transistors, said operating means for operating said heating element means with a certain repeating pattern comprising a half-wave rectifier for being disposed in series with said heating element means across said second source, said operating means for operating said heating element means with a certain repeating pattern comprising means operatively interconnected to said rectifier to cause said rectifier to fire only at certain half-wave pulses of said second-mentioned source so as to provide said repeating pattern, said rectifier comprising an SCR that has a gate, said means operatively interconnected to said rectifier comprising a capacitor and a breakover device disposed intermediate said gate of said SCR and said staircase generator of said two transistors.

4. A control device as set forth in claim 3 wherein each of said two transistors has a base and an emitter, said capacitor having one side thereof electrically interconnected to said base of one of said two transistors and to said emitter of the other of said two transistors, said one of said two transistors having said emitter thereof interconnected to said base of said other of said two transistors, said breakover device having one side thereof interconnected to said gate of said rectifier and the other side thereof interconnected to said one side of said capacitor.

* * * * *